US006393706B1

(12) United States Patent
Ferraro

(10) Patent No.: US 6,393,706 B1
(45) Date of Patent: May 28, 2002

(54) DISPOSABLE RAZOR WITH REMOVABLE RAZOR HEAD

(75) Inventor: Frank A. Ferraro, Trumbull, CT (US)

(73) Assignee: Warner-Lambert Company, Morris Plains, NJ (US)

( * ) Notice: Subject to any disclaimer, the term of this patent is extended or adjusted under 35 U.S.C. 154(b) by 0 days.

(21) Appl. No.: 09/969,824

(22) Filed: Oct. 4, 2001

Related U.S. Application Data

(62) Division of application No. 09/394,406, filed on Sep. 13, 1999, now Pat. No. 6,317,990, which is a continuation of application No. 08/137,530, filed on Oct. 15, 1993, now Pat. No. 6,026,577.

(51) Int. Cl.[7] ..... B26B 21/16; B26B 21/52

(52) U.S. Cl. ..... 30/526; 30/47

(58) Field of Search ..... 30/30, 47, 532, 30/523, 527, 530; 24/583, 585, 602, 607, 615, 625, 664, 700

(56) References Cited

U.S. PATENT DOCUMENTS

| | | | | |
|---|---|---|---|---|
| 3,768,162 | A | 10/1973 | Perry | |
| 4,026,016 | A | 5/1977 | Nissen | 30/47 |
| 4,411,065 | A | 10/1983 | Trotta | |
| 4,413,411 | A | 11/1983 | Trotta | |
| 4,422,237 | A | 12/1983 | Trotta | |
| 4,443,938 | A | 4/1984 | Bowman et al. | |
| 4,446,619 | A | 5/1984 | Jacobson | |
| 4,514,904 | A | 5/1985 | Bond | |
| 4,599,793 | A | 7/1986 | Iten | 30/85 |
| 4,679,282 | A | 7/1987 | Feng | 24/615 |
| 4,825,515 | A | 5/1989 | Wolterstorff | 24/615 X |
| 4,833,779 | A | 5/1989 | Iten | |
| 4,850,735 | A | 7/1989 | Hansen et al. | 24/615 X |
| 4,908,917 | A | 3/1990 | Kazle | 24/615 |
| 5,031,316 | A | 7/1991 | Oldroyd | |
| 5,107,590 | A | 4/1992 | Burout, III et al. | |
| 5,331,740 | A | 7/1994 | Carson, III et al. | 30/50 |

FOREIGN PATENT DOCUMENTS

| | | |
|---|---|---|
| AU | B43804/85 | 12/1986 |
| BE | 799594 | 11/1973 |
| BE | 834287 | 2/1976 |
| BE | 00554 00 | 7/1980 |

OTHER PUBLICATIONS

DM/002 456, International Design, Apr. 22, 1983.
DM/018 948, International Design, Feb. 25, 1991.
DM/002 726, International Design, Jul. 25, 1983.
DM/009 966, International Design, Dec. 30, 1987.
DM/011 218, International Design, Jun. 22, 1988.
DM/012 847, International Design, Feb. 16, 1989.
DM/012 755, International Design, Feb. 03, 1989.
DM/017 148, International Design, Jul. 16, 1990.
DM/012 976, International Design, Mar. 31, 1988.
DM/001 314, International Design, Mar. 19, 1982.
DM/001 313, International Design, Mar. 19, 1982.
DM/001 755, International Design, Aug. 29, 1982.
DM/008 260, International Design, Apr. 10, 1986.
DM/011 363, International Design, Jul. 18, 1988.
DM/019 051, International Design, Mar. 04, 1991.

*Primary Examiner*—Douglas D. Watts
(74) *Attorney, Agent, or Firm*—Fitzpatrick, Cella, Harper & Scinto

(57) ABSTRACT

A disposable razor unit having a razor head is assembled with a handle. The handle has attachment means comprising at least one prong which extends outward from the handle. The prong has a tooth on the underside of the end opposite the handle. The razor head has a chamber which receives the attachment means of the handle when the razor head and the handle are fastened together. The chamber has a clearance slot and a locking shoulder at its innermost, central point into which the tooth of the prong fits to fasten the razor head and handle together. The fit between the handle and the razor head is such that the razor head may be removed by a forward force exerted on the top of the chamber by the user, however the fit is sufficient that the handle and the razor head will not become separated by normal forces encountered during shaving.

4 Claims, 6 Drawing Sheets

DISPOSABLE RAZOR WITH REMOVABLE RAZOR HEAD

CROSS REFERENCE TO RELATED APPLICATIONS

This application is a divisional of U.S. patent application Ser. No. 09/394,406 filed Sep. 13, 1999, now U.S. Pat. No. 6,317,990 which is a continuation of U.S. patent application Ser. No. 08/137,530 filed Oct. 15, 1993, now U.S. Pat. No. 6,026,577, issued Feb. 22, 2000.

BACKGROUND OF THE INVENTION

1. Field of the Invention

The present invention relates to disposable razors and in particular to disposable razors having removable razor heads.

2. Background of the Invention

Disposable razors currently account for a large percentage of total razor usage worldwide. Typical currently available disposable razors are razors in which the razor head, containing the blade or blades, and the razor handle are permanently fastened together to form a single piece. Such razors are designed to remain effective for a certain number of uses and, once the blades become dulled, are to be discarded in their entirety. Prime advantages to the user of disposable razors are price and convenience. Because disposable razors are designed to be discarded after a certain number of uses, they are constructed of materials less expensive than those used in non-disposable razors designed for permanent use. A disadvantage of disposable razors is that disposal of the entire unit, i.e. the small razor head and the large handle, adds to the environmental burden of already cluttered landfills. In order to solve environmental problems associated with cluttered landfills, worldwide reduction of the amount of disposable products being produced is necessary. The present invention will provide a means to aid in controlling worldwide environmental problems resulting from excess disposable products.

It would, therefore, be desirable to provide a disposable razor wherein the razor unit did not have to be discarded in its entirety when the blade became dulled.

A razor unit having the desirable qualities of a disposable razor but having a removable and replaceable razor head would greatly reduce the environmental problems associated with disposable razors. Such a razor unit would allow the razor head portion, which is typically much smaller than the handle portion, to be discarded when the blade became dulled, while the larger handle portion could be re-used a number of times before being eventually discarded. In other words, the larger handle portion would be discarded less frequently than the smaller razor head, thereby reducing the amount of frequently disposable material. It would further be desirable to provide such a disposable razor wherein the razor head may be easily removed from the razor handle by a force exerted on the top surface of the razor head. The removal of the razor head in such a manner would result in a safer razor in that the user would engage the surface of the razor head opposite the blade edge in order to remove the razor head. Other means of removal may also be employed.

SUMMARY OF THE INVENTION

The present invention features a disposable razor unit having a razor head which is detachable from the handle. According to the preferred embodiment of the present invention, the handle has attachment means which consist of three independent, resilient prongs extending outward from the handle. The center prong incorporates a triangular tooth on the underside of the end opposite the handle. A chamber is positioned in the razor head to receive the attachment means of the handle when the razor head and handle are coupled. The chamber has a clearance slot and locking shoulder at its innermost, central point into which the tooth of the middle prong snap fits -to fasten the razor head and handle together for use. The tooth on the center prong springs upward as the prong is inserted into the chamber and snaps downward onto the locking shoulder upon engagement through the clearance slot to provide sufficient interference to hold the razor head in place.

The resilient prongs also provide the mechanism for the release of the razor head from the handle. The fit between the handle and the razor head is such that a finger force exerted on the top side of the razor head by the user changes the relationship of the resilient prongs with the locking shoulder and slot, and eliminates the interference which holds the razor head in place. In normal use, the fit between the razor head and the handle is sufficient so that the handle and the razor head will not become separated by normal forces encountered during shaving.

DETAILED DESCRIPTION

The embodiments of the present invention are designed to provide a disposable razor which has a removable razor head. As used herein, the term "razor head" is meant to include disposable cartridges designed for separate attachment to a razor handle, as well as the operative portion of a razor wherein the operative cutting portion is integrally formed with the handle portion. According to the present invention, razors comprised of disposable materials are disclosed which provide a removable razor head which may be separated from the razor handle by exerting a forward finger force on the top of the razor head.

Figure 1:
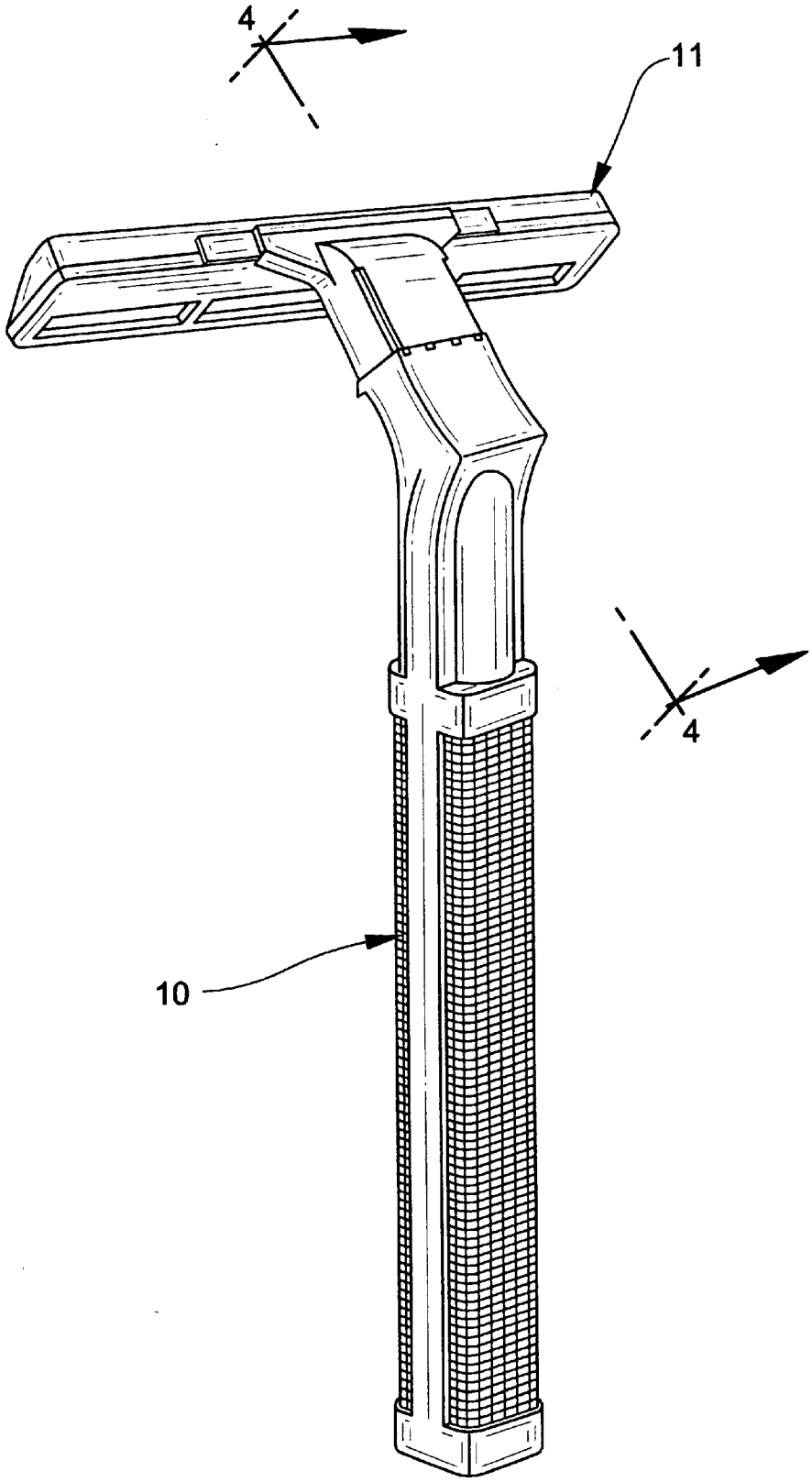
FIG. 1 is a perspective view of the razor of the invention.

The preferred embodiment of the present invention is illustrated in FIG. 1. This embodiment comprises a disposable handle 10 and a removable razor head 11 which are fastened together. The embodiment illustrated in FIG. 1 is designed for two blades. Those skilled in the art will appreciate that the handle and razor head may be of various configurations, i.e., the razor head may contain one for more blades. Preferably, razor head 11 and handle 10 are (designed for non-permanent use, i.e., they are intended to be disposed of separately after a certain number of uses.

Figure 2:
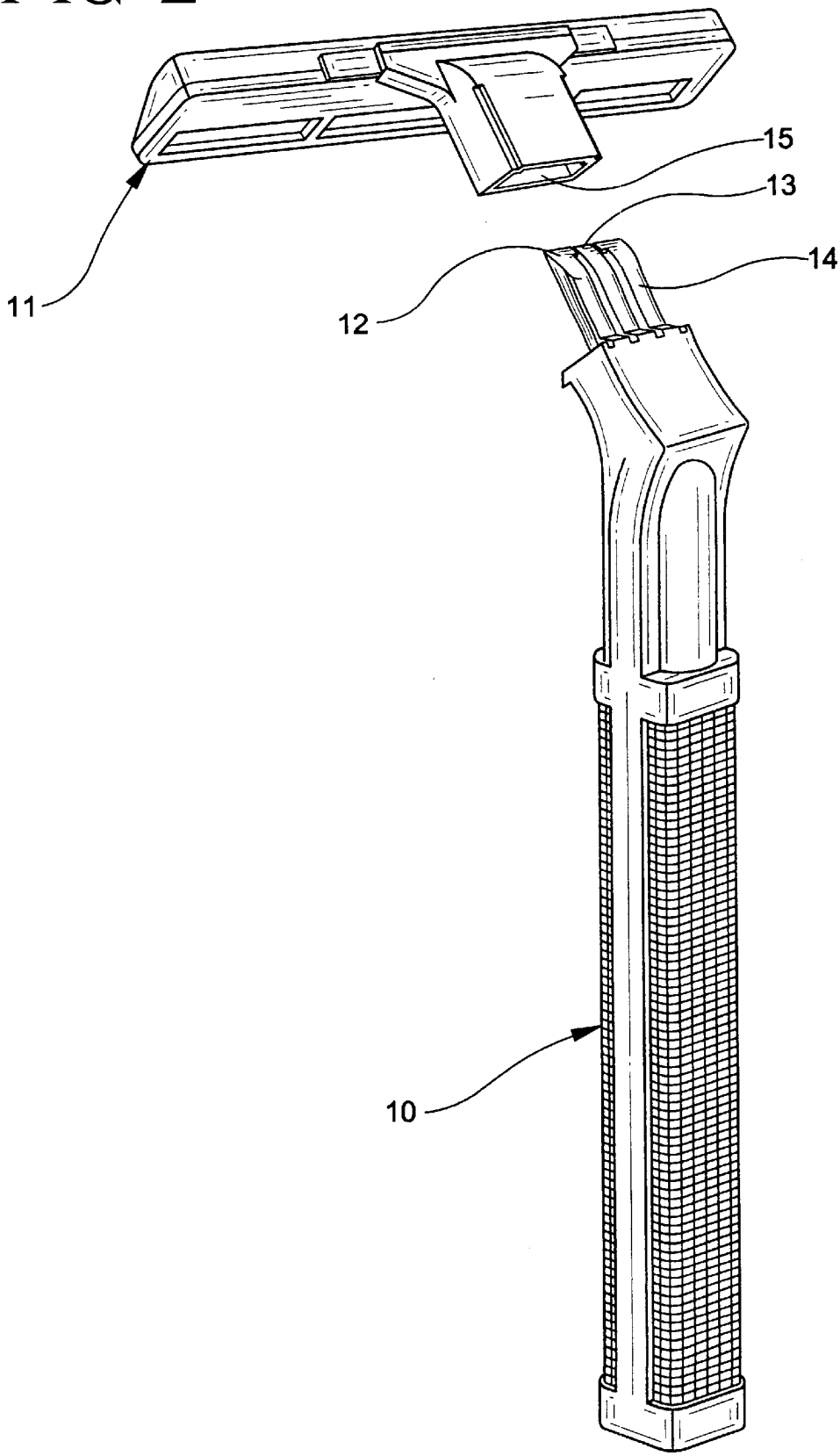
FIG. 2 is a perspective view of the razor of the present invention with the razor head separated from the handle.

FIG. 2 illustrates the preferred means for attaching the handle and the razor head. In the preferred embodiment, three independent, resilient prongs 12, 13, 14 extend outward from the end of the handle 10 to be attached to the razor head 11. Chamber 15 is positioned on razor head 11 in a manner so that prongs 12, 13, 14 may be inserted into the chamber during fastening and are enclosed within chamber 15 when the razor unit is fastened together.

Figure 3:
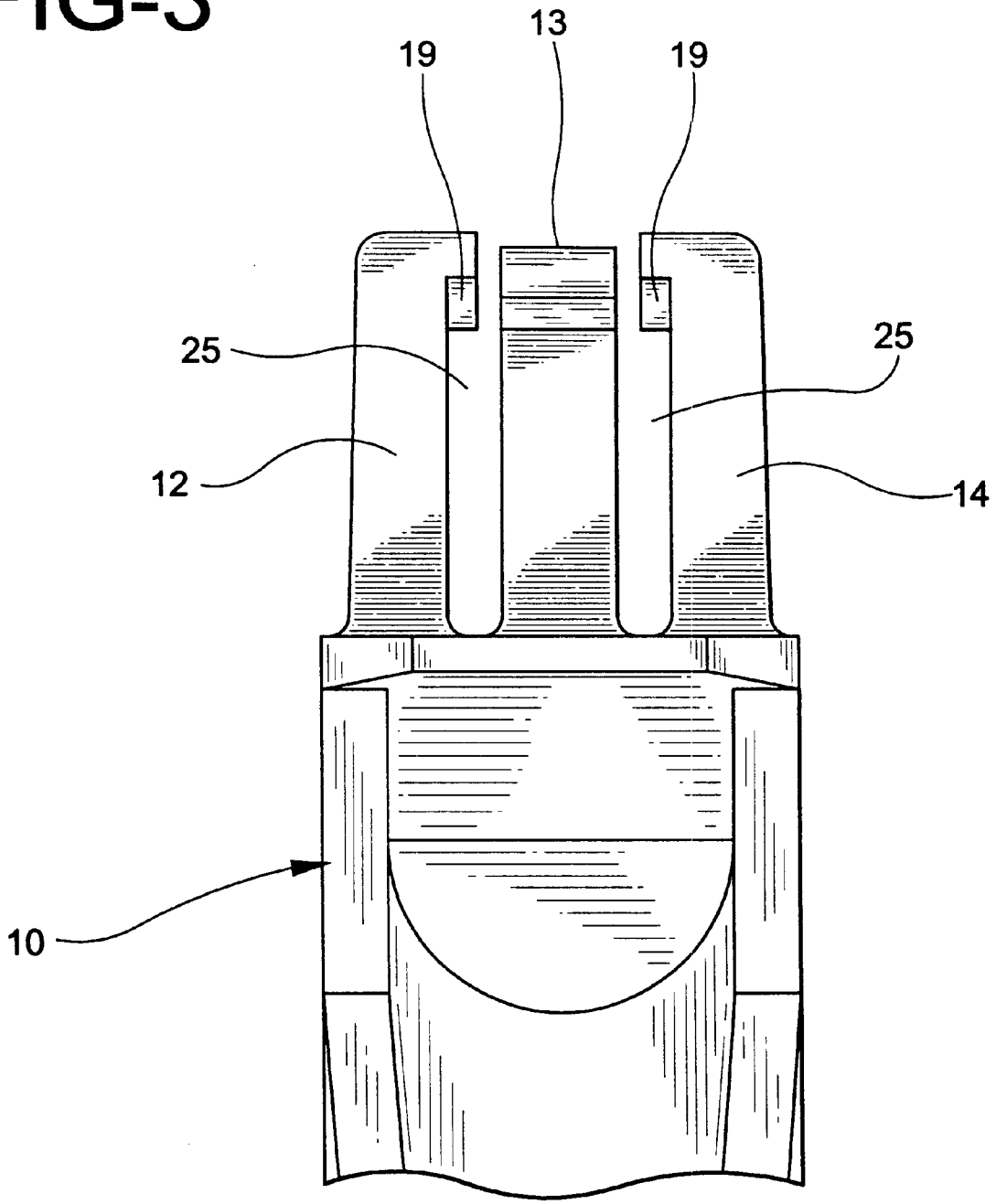
FIG. 3 is a top view of the attachment means of he present invention.

FIG. 3 illustrates the top of the three independent, resilient prongs 12, 13, 14 of the preferred embodiment of the present invention. The two end prongs 12, 14 have tabs 19 which extend inward toward the central prong 13. Open areas 25 are created between each prong so that each prong nay move independently of the other prongs.

Figure 4:
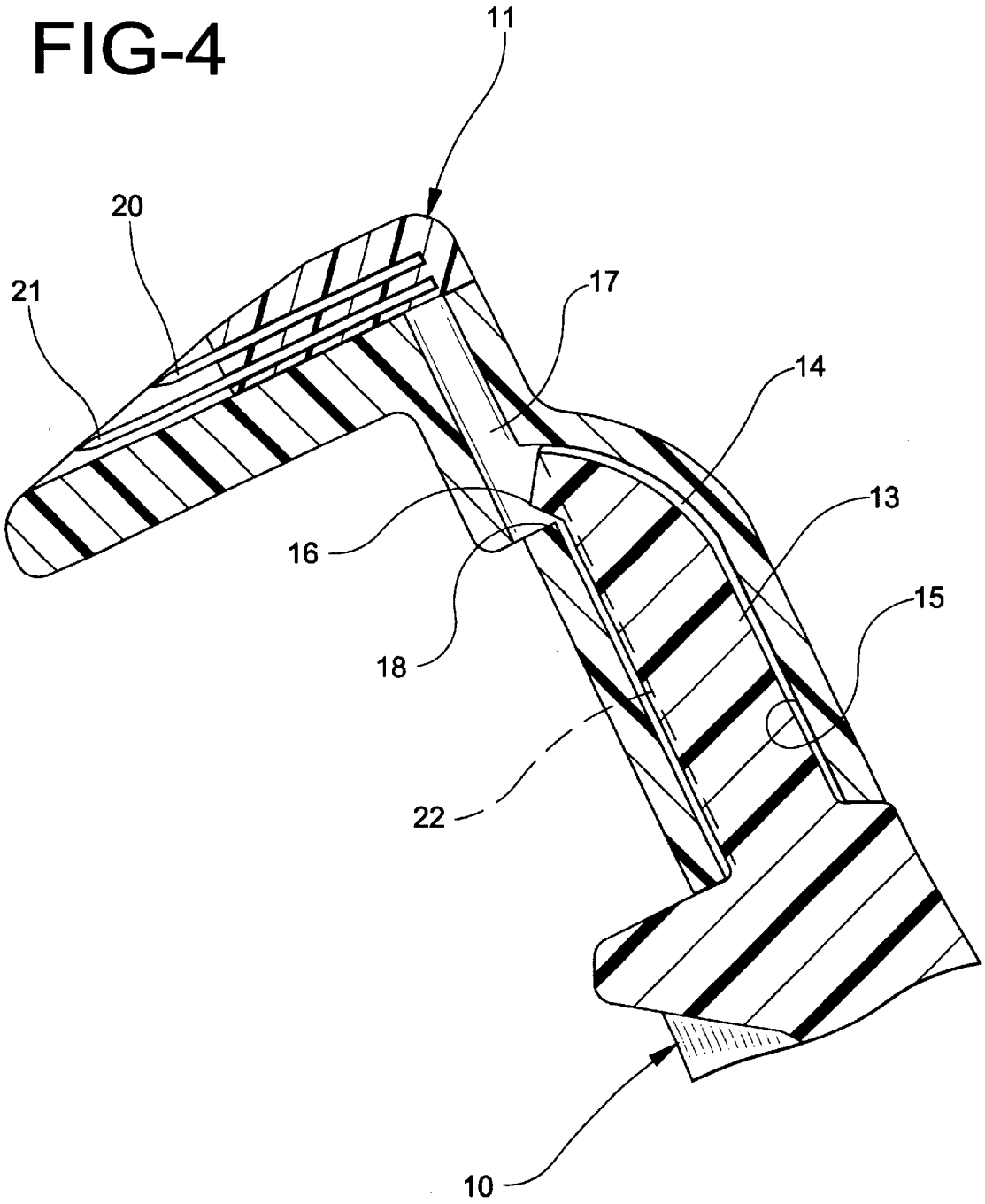
FIG. 4 is a cross-sectional view in the plane of the line 4—4 of FIG. 1 in which the tooth is engaged with the locking shoulder.
Figure 5:
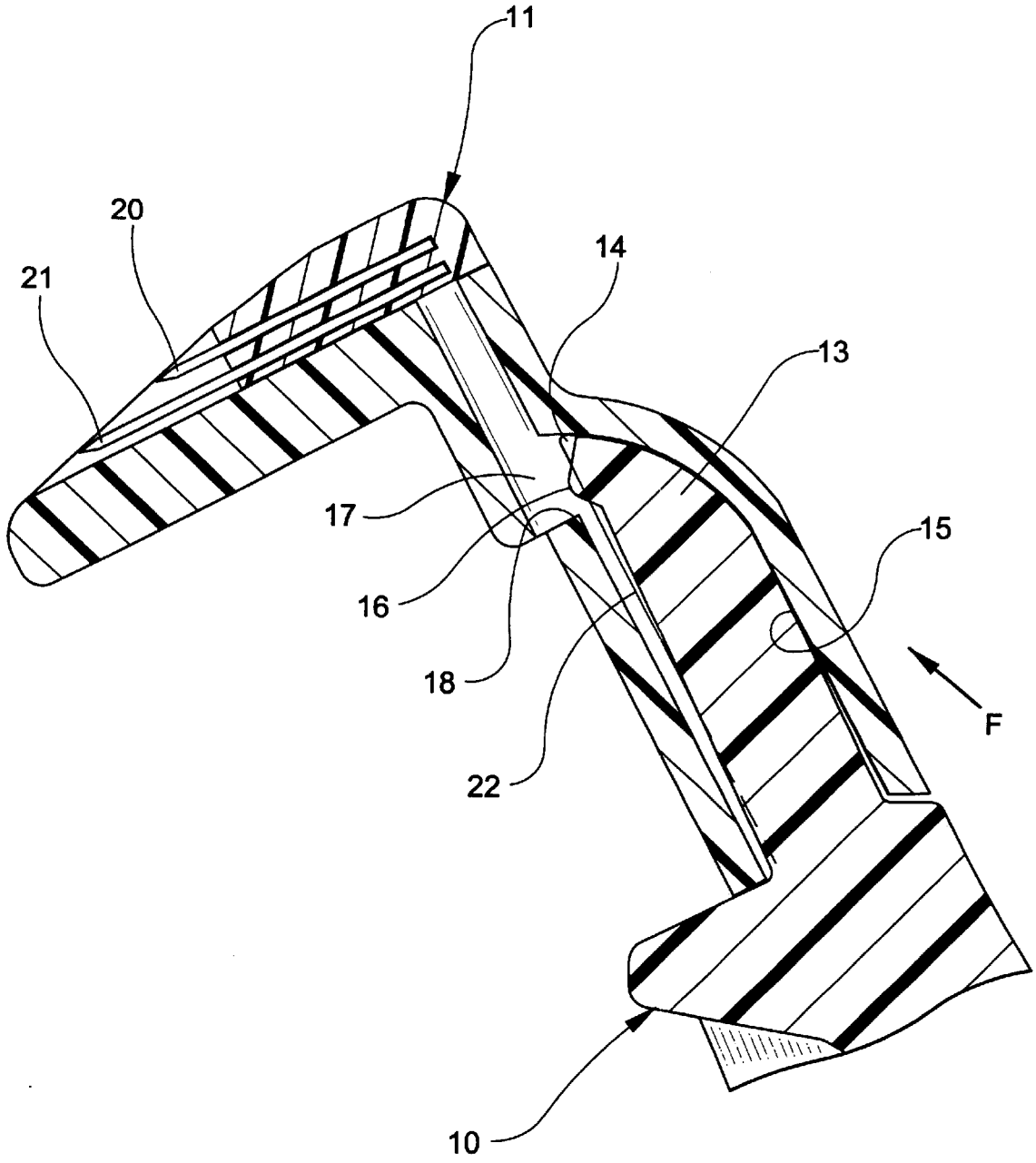
FIG. 5 is a cross-sectional view in the plane of the line 4—4 of FIG. 1 with the tooth disengaged from the locking shoulder.
Figure 6:
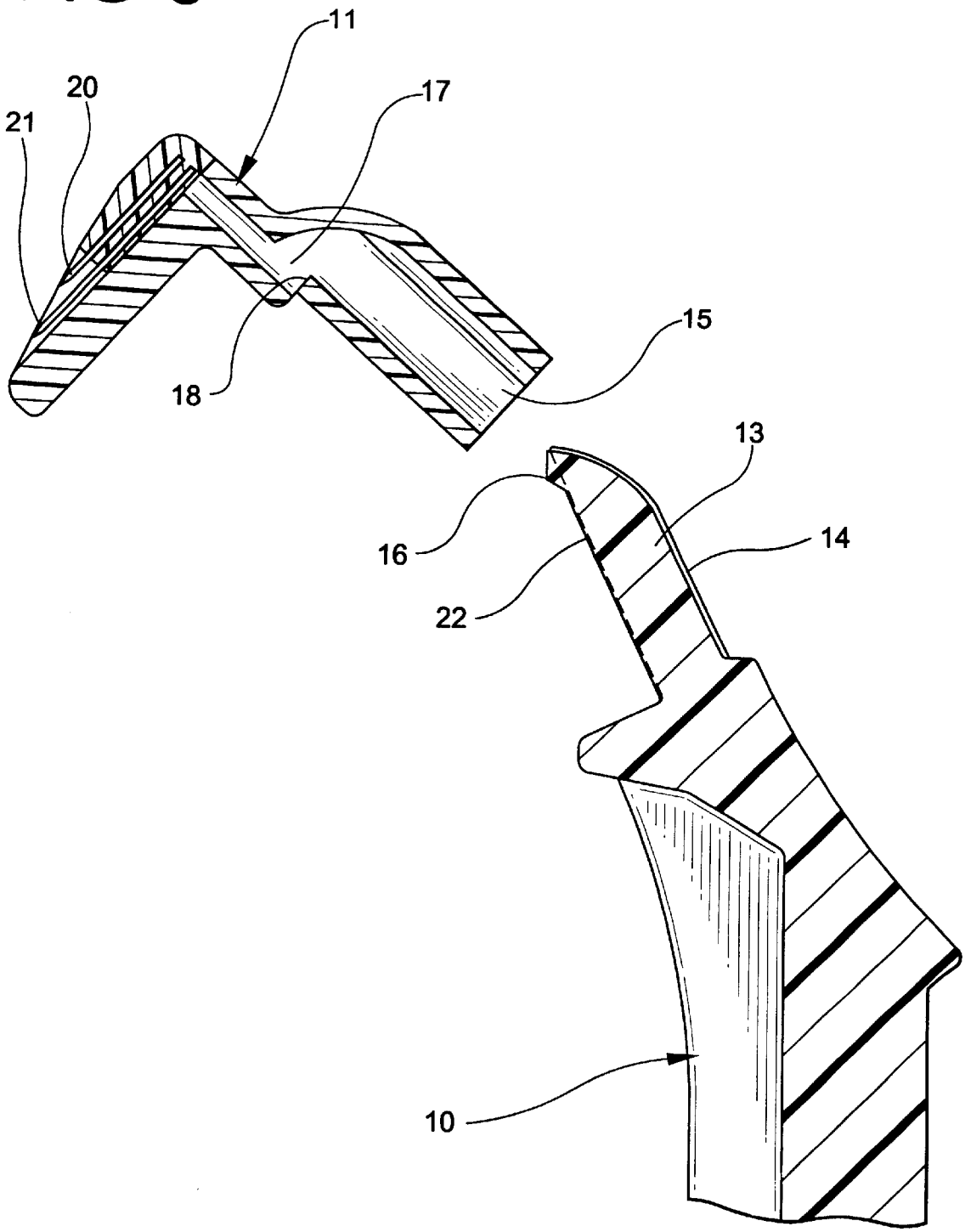
FIG. 6 is a cross-sectional view in the plane of the line 4—4 of FIG. 1 with the razor head separated from the handle.

FIGS. 4 and 5 illustrate a cross-section of the attachment means of the present invention. FIG. 4 illustrates the razor head 11 and handle 10 fastened together in the preferred manner by prongs 12, 13, 14 which are unclosed within the chamber 15. Center prong 13 has a tooth 16 located on its underside at the end farthest from the handle. Clearance slot 17, located in the innermost central point of chamber 15, is large enough to accommodate tooth 16. Locking shoulder 18 is provided on the underside of chamber 15, adjacent to the clearance slot 17. Perhaps as best illustrated in FIG. 5, the preferred at rest alignment of enter prong 13, shown in cross section, is lower than that of end prongs 12, 14. When the entire unit is fastened together, center prong 13 retains its lower at rest alignment when tooth 16 is snap fit within clearance slot 17. In such position, the unit is securely fastened together by an interference fit between tooth 16 fitting within clearance slot 17 and thereby engaging locking shoulder 18 in the razor head 11. When the unit is so fastened together via tooth 16, clearance slot 17 and locking shoulder 18, the razor head 11 will not move independently of the handle 10 in response to forces encountered during shaving.

As illustrated in FIG. 5, razor head 11 and handle 10 may be separated by the exertion of force F on the top, outer side of chamber 15, i.e., on the surface of the razor head opposite to blades 20, 21. Force F can vary widely, but preferably is within the range of 0.5 to 15 pounds. Such force causes center prong 13 to deform from its at rest alignment and raise so that tooth 16 disengages from clearance slot 17 and locking shoulder 18 and eliminates the interference fit. The removal of the interference allows the handle 10 to be separated from the razor head 11. The removal of the razor head in such a manner is safe for the user in that the user's hand contacts the portion of razor head 11 opposite to blades 20, 21, thus reducing the chance of injury from the blades.

Similarly, during attachment of the razor head and the handle, center prong 13 is deformed upward as prongs 12, 13, 14 are inserted into chamber 15. Center prong 13 returns to its lower at rest alignment upon engagement of tooth 16, with clearance slot 17 and locking shoulder 18 in order to attach the razor head and the handle together.

According to an alternative embodiment of the present invention, a shaving aid is incorporated into the razor head of the present invention. It will be appreciated by those skilled in the art that the shaving aid can be incorporated by several different methods including attaching or embedding the shaving aid to a portion of the razor head.

Exemplary materials constituting the shaving aid may comprise one or various combinations of the following:

A. lubricating agent for reducing the frictional forces between the razor head and the skin, e.g., a microencapsulated silicone oil.

B. An agent which reduces the drag between the razor parts and the skin, e.g., a polyethylene oxide in the range of molecular weights between 100,000 and 600,000; a non-ionic polyacrylamide; and/or a natural polysaccharide derived from plant materials such as "guar gum".

C. An agent which modifies the chemical structure of the hair to allow the razor blade to pass through the whiskers very easily, e.g., a depilatory agent is one example.

D. A cleaning agent which allows whiskers and skin debris to be washed more easily from the razor parts during shaving, e.g., a silicone polyethylene oxide block copolymer and detergent such as sodium lauryl sulphate.

E. A medicinal agent for killing bacteria, or repairing skin damage and abrasions.

F. A cosmetic agent for softening, smoothing, conditioning or improving the skin.

G. A blood coagulant for the suppression of the bleeding that occurs from nicks and cuts.

H. An essential oil such as menthol.

As has been mentioned hereinabove, the configuration of the shaving aid, its place of application to the razor head, the manner of attachment and/or other means and method of incorporation may vary widely to fit particular requirements.

While there have been described what are presently believed to be the preferred embodiments of the invention, those skilled in the art will realize that various changes and modifications may be made to the invention without departing from the spirit of the invention, and it is intended to claim all such changes and modifications as fall within the scope of the invention.

What is claimed is:

1. A method of assembling a razor unit comprising the steps of:

providing a handle including an attachment in the form of at least one prong extending outwardly therefrom;

providing a disposable cartridge containing at least one blade and having a separate enclosing chamber positioned thereon and extending therefrom, said prong being insertable into said chamber and enclosed within the chamber in contacting relationship with a side of the chamber to form a fit which supports the cartridge on the handle, said side of said chamber and said prong together forming a resiliently supported tooth and a clearance slot, located at the innermost point of said chamber, said resiliently supported tooth being positioned to snap into and held securely in said clearance slot when said prong is fully inserted into said chamber, said tooth and said slot forming an interference fit which is sufficient to hold the cartridge onto the handle during shaving but which allows a force applied to said cartridge in a direction along said prong and outward from said handle to disengage the tooth from the clearance slot to permit removal of the cartridge from the handle; and inserting said prong of said handle into said chamber by an amount sufficient for said tooth to engage said slot, whereby said cartridge is firmly yet removably attached to said handle.

2. A method according to claim 1, wherein a force of 0.5 to 15 pounds is required to remove said cartridge from said handle.

3. A method of maintaining a razor unit which includes:

a handle including an attachment in the form of at least one prong extending outwardly therefrom, and a disposable cartridge containing at least one blade and having a separate enclosing chamber positioned thereon and extending therefrom, said prong being inserted into said chamber and enclosed within the chamber in contacting relationship with a side of the chamber to form a fit which supports the cartridge on the handle, said side of said chamber and said prong together forming a resiliently supported tooth and a clearance slot, located at the innermost point of said chamber, said resiliently supported tooth being snapped into and held securely in said clearance slot when said prong is fully inserted into said chamber, said tooth and said slot forming an interference fit which is sufficient to hold the cartridge onto the handle during shaving but which allows a force applied to said cartridge in a direction along said prong and outward from said handle to disengage the tooth from the clearance slot to permit removal of the cartridge from the handle, said method comprising the steps of:

removing said cartridge from said handle by exerting a force on the cartridge in a direction along said prong and away from said handle by an amount sufficient to force said tooth out of said slot and to remove said cartridge from said handle; and attaching, to said handle, another cartridge having a chamber containing at least one blade and having a separate enclosing chamber positioned thereon and extending therefrom, said attaching being carried out by inserting said prong of said handle into said chamber of said another cartridge by an amount sufficient for said tooth to engage said slot, whereby said another cartridge is firmly yet removably attached to said handle.

4. A method according to claim 3, wherein said cartridge is removed from said handle by application of a force between said cartridge and said handle in a direction along said prong of 0.5 to 15 pounds.

* * * * *

UNITED STATES PATENT AND TRADEMARK OFFICE

CERTIFICATE OF CORRECTION

PATENT NO. : 6,393,706 B1
DATED : May 28, 2002
INVENTOR(S) : Frank A. Ferraro

It is certified that error appears in the above-identified patent and that said Letters Patent is hereby corrected as shown below:

Title page,
Item [57], ABSTRACT,
Line 9, “user,” should read -- user --;

Column 2,
Line 8, “fits -to” should read -- fits to --;
Line 30, “of he” should read -- of the --;
Line 61, “for” should read -- or -- ;
Line 63, “(designed” should read -- designed --;

Column 3,
Line 17, “farthest” should read -- furthest --;
Line 10, “nay” should read -- may --;
Line 22, “enter” should read -- center --;
Line 61, “lubricating” should read -- A lubricating --;

Column 4,
Line 27, “as- fall” should read -- as fall --.

Signed and Sealed this

Twenty-first Day of January, 2003

JAMES E. ROGAN
*Director of the United States Patent and Trademark Office*